United States Patent [19]

Gill

[11] Patent Number: 4,538,734

[45] Date of Patent: Sep. 3, 1985

[54] DISK SCREEN APPARATUS, DISK ASSEMBLIES AND METHOD

[75] Inventor: Michael L. Gill, Beloit, Wis.

[73] Assignee: Beloit Corporation, Beloit, Wis.

[21] Appl. No.: 513,761

[22] Filed: Jul. 14, 1983

[51] Int. Cl.[3] ..... B07B 13/04

[52] U.S. Cl. ..... 209/668; 209/672; 403/349

[58] Field of Search ..... 209/671, 672, 667, 668; 403/319, 348, 359, 349

[56] References Cited

U.S. PATENT DOCUMENTS

| | | | |
|---|---|---|---|
| 617,197 | 1/1899 | Smith | 209/668 |
| 1,399,211 | 12/1921 | Hollingbery | 209/672 |
| 1,418,899 | 6/1922 | Acken | 209/671 |

*Primary Examiner*—Robert B. Reeves
*Assistant Examiner*—Edward M. Wacyra
*Attorney, Agent, or Firm*—Hill, Van Santen, Steadman & Simpson

[57] ABSTRACT

Disk screen apparatus and disk assemblies therefore wherein each disk assembly comprises an elongate shaft adapted to be rotatably mounted in the disk screen apparatus. The shaft has elongate indexing and keying structure extending longitudinally along and rigid with the shaft and providing a longitudinally extending and circumferentially facing edge. The edge has a series of longitudinally spaced circumferentially extending indexing and keying notches therein. Annular screen disks are mounted on the shaft and have inner diameter key shoulders engageable in the notches. The keying structure may be raised along a longitudinal area on the cylindrical perimeter of the shaft or recessed along such area. A releasable locking bar is adapted for locking the key shoulders in the notches.

20 Claims, 8 Drawing Figures

FIG. 1
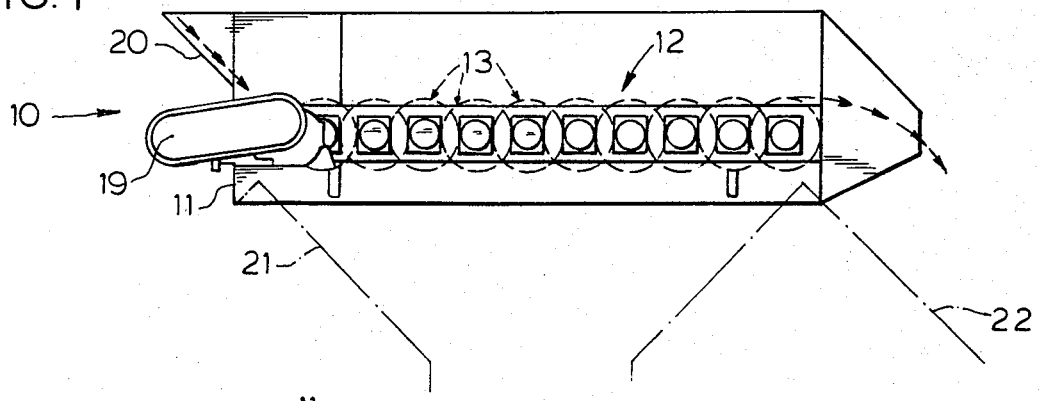
FIG. 2
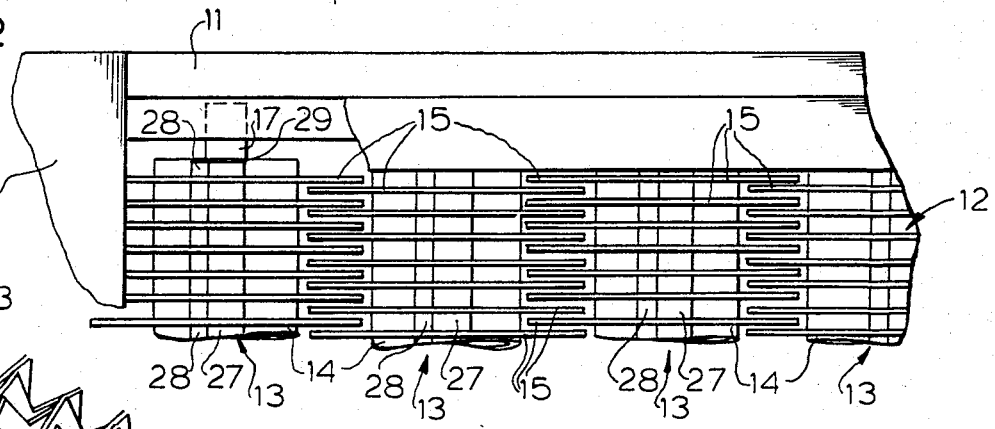
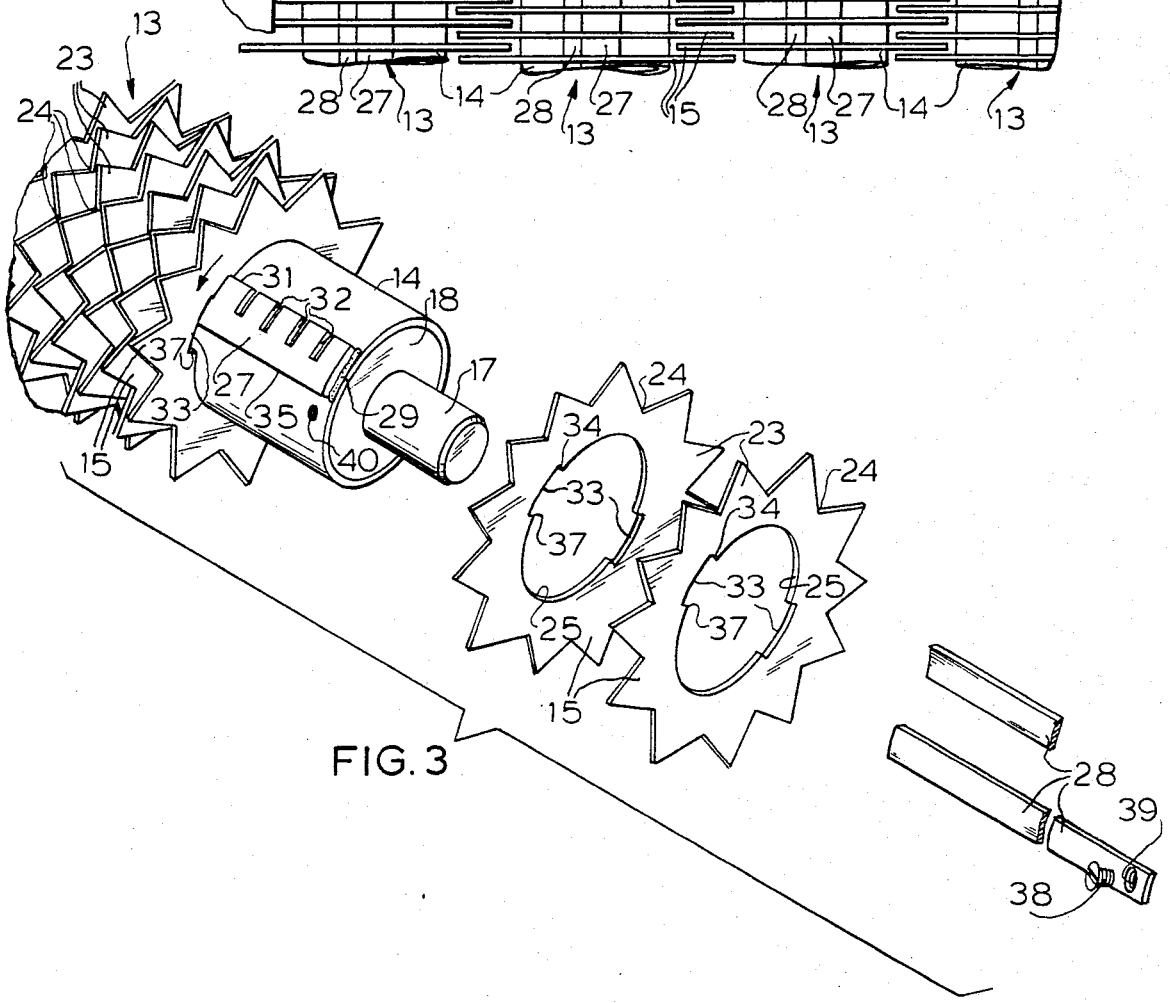
FIG. 3

DISK SCREEN APPARATUS, DISK ASSEMBLIES AND METHOD

The present invention relates to disk screen apparatus of the general type disclosed in U.S. Pat. No. 4,301,930, which to any extent necessary is incorporated herein by reference; and is more particularly concerned with such apparatus embodying new and improved disk screen assemblies and method of making the same.

In the aforesaid patent, it is pointed out, among other things, that in the prior art there have been some problems with the disk screens due to the large number of disks on the shafts of the disk assemblies. Even slight variations in manufacturing tolerances have been found detrimental to slot widths from one side of the screen bed to the other side of the screen bed. In order to attain fairly uniform slot widths, a tremendous amount of hand fitting was required by following prior practices. Such hand fitting has been found to be unpredictable as to results, time consuming and expensive. Where quite narrow slot widths were required, the problem was particularly troublesome. This problem was serious enough where the slot widths defined by the disks was on the order of 10 millimeters. Industry demands aggravated the problem by requiring narrower slot widths, such as 8 mm and 5 mm.

The teaching of the aforesaid patent was an important step forward in the art, and comprises welding the disks by multiples onto relatively short hubs and then mounting a series of the hubs on and along each rotary shaft in the screen bed. However, some difficulty has been experienced with securing adequate strength at the weldmet between the hub and the inner diameter of the disks. Loosening of the disks from the hub due to weld failure is a hazard that may be encountered where the rotary screen disks are subject to unusual loading stresses such as where rocks or other hard foreign matter is encountered in operation. The relatively short module tubular hub mounting of the disks as disclosed in U.S. Pat. No. 4,301,930 does facilitate replacement of damaged disks in a disk assembly as compared, for example, to welding of the disks directly to the shafts as disclosed in U.S. Pat. No. 4,037,723 so that if some disks are damaged replacement is so costly that often the entire shaft is discarded rather than replacing the disks.

Retention of the disks fairly accurately on the shafts is accomplished by the arrangement disclosed in the U.S. Pat. No. 4,239,119 wherein segmental slotted disk retainers are mounted on the shafts and the disks have internal splines that are received in the slots. However, this is a high cost arrangement and entails cumbersome assembly manuevers.

An important object of the present invention is to provide a new and improved disk screen apparatus, disk assemblies, and method, which will overcome the disadvantages, drawbacks, inefficiencies, shortcomings and problems inherent in prior arrangements and methods.

Another object of the invention is to provide a new and improved disk screen apparatus in which the disk assemblies are of a new and improved construction wherein individual disks can be easily and efficiently replaced if necessary.

A further object of the invention is to provide a new and improved screen disk assembly which can be produced more efficiently and at lower cost than prior constructions.

Still another object of the invention is to provide a new and improved method of making screen disk assemblies.

In accordance with the principles of the present invention, there is provided a disk screen apparatus, and a disk assembly therefor comprising an elongate shaft having means at opposite ends for rotatably mounting the assembly in disk screen apparatus, an elongate indexing and keying structure extending longitudinally along and rigid with the perimeter of the shaft and providing a longitudinally extending and circumferentially facing edge, the edge having a series of longitudinally spaced circumferentially extending indexing and keying notches therein, annular screen disks mounted on said shaft and having inner diameters with key means engageable in said notches, and means for locking said key means in said notches and thereby retaining said disks spaced from one another in accordance with said notches and corotative with said shaft.

The present invention also provides a method of making a disk assembly for a disk screen apparatus, comprising providing an elongate shaft having means at opposite ends for rotatably mounting the assembly in disk screen apparatus, providing on said shaft an elongate indexing and keying structure extending longitudinally and rigid with the shaft and with a longitudinally extending and circumferentially facing edge, forming in said edge a series of longitudinally spaced circumferentially extending indexing and keying notches, mounting on said shaft annular screen disks having inner diameter key means, engaging said key means in said notches, and locking said key means in said notches and thereby retaining said disks spaced from one another in accordance with said notches and corotative with said shaft.

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which:

FIG. 1 is a side elevational schematic illustration of a disk screen apparatus in which are rotatably mounted cooperating disk screen assemblies embodying the present invention;

FIG. 2 is an enlarged fragmental top plan view showing a fragment of the screening bed of the apparatus in FIG. 1;

FIG. 3 is a fragmentary exploded assembly view, for assistance in understanding the method of making a disk assembly embodying the present invention;

Figure 4:
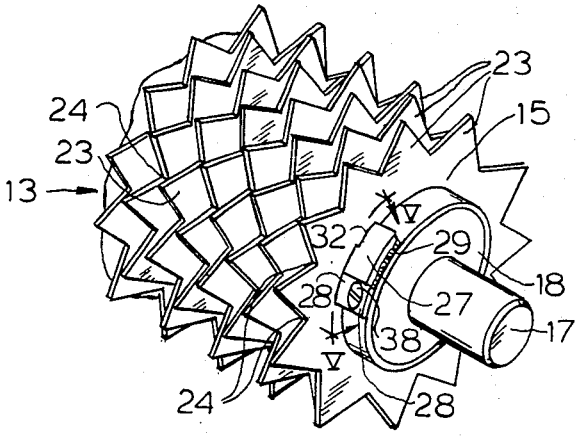
FIG. 4 is a fragmentary perspective view of a completed disk assembly embodying the present invention.
Figure 5:
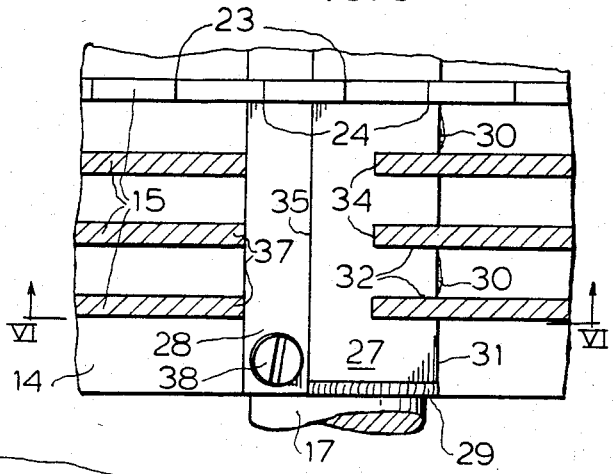
FIG. 5 is an enlarged fragmentary sectional plan view taken substantially along the line V—V in FIG. 4.

As shown in FIGS. 1 and 2, a typical disk screen apparatus 10 comprises a frame 11 supporting a screening bed 12 having a series of corotating, cooperatively related parallel disk screen assemblies 13. Each of the assemblies 13 includes a cylindrical perimeter shaft 14. All of the shafts 14 may be of hollow tubular construction and may be of similar length and each carrying a longitudinally spaced series of concentric screen disk 15 which are cooperatively related to interdigitate, as best seen in FIG. 2, with the screen disks 15 of the adjacent shafts.

At both of their opposite ends, the shafts 14 may be equipped with suitable respective stub shafts 17 (FIGS. 2 and 3) which are journalled in the frame 11. In a desirable form, the stub shafts 17 are mounted concentrically on respective end disks 18 which are welded into the ends of the associated shafts 14. All of the shafts 14 are driven in unison in the same direction, clockwise as seen in FIG. 1, by a suitable drive means 19.

Material such as wood chips to be screen is delivered to the infeed end of the screening bed 12 by means of a chute 20, and, as indicated by directional arrows, drops onto the receiving end of the screening bed. Acceptable size wood chips drop down through the screen slots by and between the disk 15, and are received in a hopper 21. Oversized wood chips, and other materials too large to pass through the screening slots, are advanced to and discharged, as indicated by directional arrows, from the rejects end of the screening bed 12 to an outfeed chute 22.

The screening function of the disk 15 is enhanced by a uniform generally saw-tooth configuration of the outer perimeters of the disk 15, provided by teeth 23 and intervening clearances 24. Desirably the teeth 23 are somewhat shorter than the extent of interdigitation of the disks. By virtue of the disks 15 all rotating in a common direction, efficient screening out of oversize matter and advancing of the oversize matter to the rejects or discharge end of the screening bed 12 are efficiently accomplished.

For maximum screening efficiency, all of the disks 15 must be as free as possible from warpage, and must be as accurately as possible spaced from one another in each of the disk assemblies 13, so that the screening slots defined by and between the interdigitated disks will be accurate within a closely controlled tolerance requirement. These desirable parameters are simply, efficiently and economically attained by the present invention.

Each of the elongate shaft 14 has a preferably cylindrical periphery, and each of the disks 15 is of annular construction and has an inner diameter perimeter 25 which is dimensioned to receive the associated shaft 14 in close but freely slidable relation, and new and improved means are provided for retaining the disks 15 spaced from one another along the associated shaft 14 and corotative with the shaft. Such means comprises elongate indexing and keying structure 27 extending longitudinally along and rigid with the shaft 14, and locking means 28.

Figure 6:
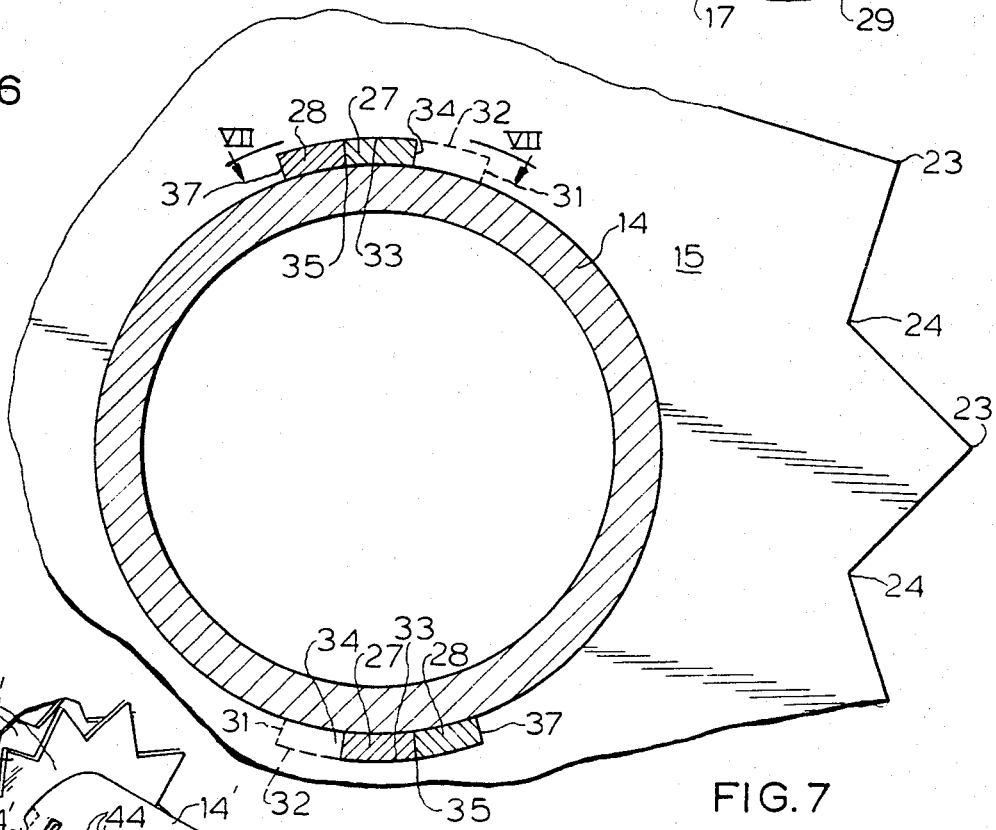
FIG. 6 is a fragmentary sectional elevational view taken substantially along the line VI—VI in FIG. 5.

In one desirable form, each of the indexing and keying structures 27 comprises an elonate, limited width, relatively narrow (compared to the circumference of the shaft) plate strip of suitable gauge about as long as the body of the associated shaft 14 and desirably transversely arched or curved complementary to and uniformly engaging the subjacent longitudinal area of the perimeter of the shaft 14, as best visualized in FIG. 6. Fixed attachment of the strip 27 to the shaft 14 may be effected in any desirable manner which will hold the strip fixedly on the shaft and thoroughly resistant to displacement when subjected to the stresses and strains encountered in operation. Although securement of the strip 27 to the shaft 14 may be by spot welding or by means of screws, or clamp structure, in a desirable mode, as shown, at least the opposite ends of the strip 27 may be secured by welding 29 to the shaft (FIGS. 2–5). For greater assured stability, the strip 27 may also be secured by welding 30 at least at intervals along one longitudinally extending and circumferentially facing edge 31. In a preferred arrangement, as best seen in FIG. 6, the shaft 14 is equipped with a plurality of the strips 27, such as two located at diametrical opposite sides of the shaft 14.

For spaced indexing and keying of the disks 15 on and along the shaft 14, each of the strips 27 has in its edge 31 a series of longitudinally spaced circumferentially extending indexing and keying notches 32 which extend inwardly from the edge 31 to desirably about half the width of the strip 27.

Each of the disks 15 has in its inner diameter edge 25 clearance recesses 33 of a depth and width equal to the thickness and width of the strips 27 but so designed as to freely but closely slidably receive the strips 27 for longitudinal mounting of the disks 15 successively onto the shaft 14 starting at either end and working toward the opposite end. As each of the disks 15 reaches the location along the strip 27 at which the respective disk is to be retained on the shaft 14, as determined by the indexing and keying notch 32 at that location, the disk is simply turned about its axis so that an inner edge key shoulder portion 34 of the disk at the side of the notch 33, serving as inner diameter key means on the disk, will be engaged in the notch and bottomed in the inner, blind end of the notch, as indicated by the directional arrow in FIG. 3. This shifts the disk circumferentially relative to the strip 27 so that there is a gap between a longitudinal edge 35 of the strip 27 and a shoulder 37 located on the opposite side of the recess 33 from the key means shoulder 34. When all of the disks 15 have been mounted on the shaft 14 and rotated to engage the key shoulders 34 thereof into the indexing and keying notches 32, the locking means in the form of bars 28 are slid into place longitudinally along the edges 35 through the gaps defined with the shoulders 37, thereby locking the disks firmly in place. It will be appreciated, of course, that each of the locking bars 28 is of a width and thickness to fill the associated locking gaps as closely as practicable while still permitting the locking bars to be slid into place. Each of the locking bars 28 may be about as long as the associated indexing and keying strips 37. Any suitable means may be employed to secure the locking bars 28 in place, desirably removably so as to permit removal of the disk 15 by reverse manuever from that described for mounting the same when desired. A practical means for accomplishing removable securement of the bars 28 comprises in each instance a countersunk screw 38 engageable through a screw hole 39 in one end portion of the bar 28 and threadedly engageable in a screw socket 40 provided therefor in the selected end portion of the shaft 14 accessible outwardly relative to the adjacent disk 15.

Figure 8:
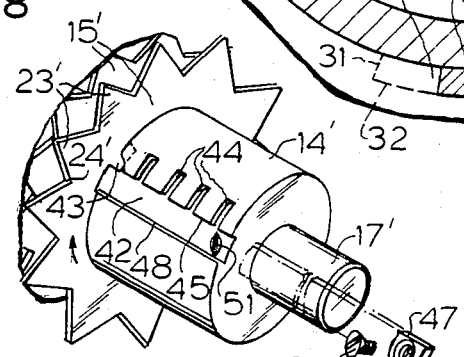
FIG. 8 is a fragmentary schematic perspective view showing a modification.
Figure 7:
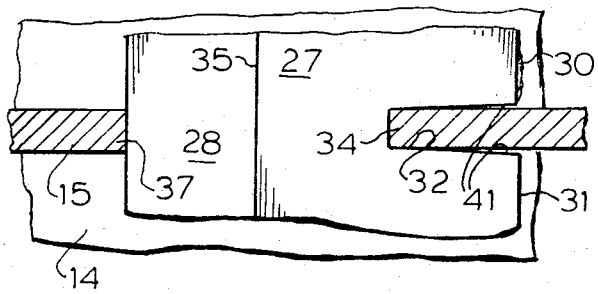
FIG. 7 is a fragmentary sectional plan view taken substantially along the line VII—VII in FIG. 6.

For easing reception of the key shoulders 34 into the keying notches 32, the notches are desirably provided with convergently tapered sides 41 (FIG. 7) providing a notch mouth which is slightly wider than the disk thickness, and leading into an inner end portion of the notch which is closely dimensioned to the disk thickness for snug engagement with the faces of the disk at the shoulder 34.

Where a solid shaft 14' (FIG. 8) is used, equipped with journals 17' which may be solid part of the shaft or attached as preferred, or the shaft is hollow but of sufficient thickness, indexing and keying of disk screen disks 15' may be effected by providing the indexing and keying structure in the form of a longitudinal groove or channel 42 in the perimeter of the shaft, at one location or at a plurality of circumferentially spaced locations such as diametrically opposite sides of the shaft. At the inner perimeter of the disks 15' they are provided with respective radially inwardly extending key means lugs 43 which are dimensioned to engage in close but freely slidable relation within the channel or channels 42 while the inner diameters 25' of the disks 15' engage in close slidable relation with the perimeter of the shaft 14'. At desired longitudinally spaced intervals, indexing and keying notches 44 are formed in the perimeter of the shaft 14' in one edge 45 defining the channel 42. The circumferential depth of the notches 44 is equal to the width of the key lugs 43. Thereby, after the disks 15' have been slid into place along the length of the shaft 14' to the selected mounted positions, the key lugs 43 which have slid along the channels 42 are adapted to be engaged in the selected indexing and keying notches 44 by turning the disks as indicated by directional arrow in FIG. 8. Then the disks are locked in place by sliding a properly dimensioned locking bar 47 into and along the channel 42 for locking the disk key lugs 43 into the notches 44. For this purpose, of course, the locking bar 47 is of a width to fit slidably between the longitudinal shoulder edge 45 and a longitudinal shoulder edge 48 along the opposite side of the channel 42. Removable securement of each of the bars 47 is adapted to be effected, similarly as for the locking bar 28, by means such as a countersunk screw 49 received in a countersunk clearance hole 50 in one end portion of the bar 47 and adapted to be screwed into a tapped socket 51 provided therefor in the selected end portion of the channel 42.

In order to attain a desirable alternation of the teeth 23, 23' and the clearances 24, 24' of the disks in the set along the shaft 14, 14', the clearance recesses 33 in respect to the disks 15 and the key lugs 43 in respect to the disk 15' are properly oriented on each alternate disk by a half tooth circumferentially offset relation. Thereby, as best visualized in FIGS. 3 and 4, each alternate disk 15 has the teeth 23 and the clearances 24 in longitudinal alignment along the axis of the shaft 14, and the alternate intervening disks are similarly aligned so that the teeth 23 of each of the disks is offset by one-half tooth width from the teeth of each contiguous disk. To the same effect in respect to the disks 15' of FIG. 8, wherein each disk 15' has the teeth 23' offset circumferentially by $\frac{1}{2}$ tooth width from the contiguous disk 15' and thereby aligned in the longitudinal direction of the assembly with the clearances 24' of the contiguous disks. This provides the desirable customary appearance of the disks teeth being oriented in spiral patterns as is shown in FIGS. 3 and 4. This orientation of the disks teeth has been adopted, of course, to improve functioning of the cooperating disks in the disks screen bed 12.

From the foregoing, it will be readily apparent that the present invention has provided a new and improved, efficient screen disk assembly in which accurate orientation of the disks on each shaft is facilitated. Welding of the disks in place is avoided, and disk replacement, if necessary, is greatly facilitated. Since it is the disks that are liable to be damaged in service, even if all of the disks on any shaft have to be replaced, at least the shaft and the disk indexing and keying and locking mechanism may be salvaged and reused. More likely, however, just those disks that are damaged may need to be replaced in any given instance. That can be easily accomplished with minimum downtime and labor expenditure, with no more than a screw driver or other suitable tool for releasing the locking bar on any shaft and then pulling the affected disks and replacing them where necessary. Disk replacement may be effected in the screening room without returning the disk assembly to the repair shop. Both the original manufacture of the disk assemblies, and servicing of the assemblies are advantageously both equipment and labor cost effective.

It will be understood that variations and modifications may be effected without departing from the spirit and scope of the novel concepts of this invention.

I claim as my invention:

1. A disk screen apparatus comprising a screening bed having a series of corotating spaced parallel elongate disk assemblies each of which has a longitudinal series of concentric screen disks which interdigitate in axially spaced relation with the screen disks on the adjacent disk assemblies, and comprising:

each of said disk assemblies having an elongate shaft provided with means at opposite ends for rotatably mounting the assembly in the disk screen apparatus;

an elongate indexing and keying structure extending longitudinally along and permanently rigid with the perimeter of said shaft and providing a longitudinally extending and circumferentially facing edge;

said edge having a series of longitudinally spaced circumferentially extending indexing and keying notches therein for determining the positions of the disks relative to one another along the length of the shaft;

said screen disks being annular and mounted on said shaft and having inner diameters which engage said shaft perimeter;

key means on said inner diameters engageable in said notches;

each of said disks being movable along the length of said shaft by sliding its inner diameter along said perimeter and with said key means freely movable along said edge until aligned with a selected notch, and the key means being then assembled in the aligned notch by relative rotation of the disk and shaft;

and means for locking said disks in their selected positions with said key means in said notches and thereby retaining said disks spaced from one another in accordance with said notches and corotative with said shaft.

2. Apparatus according to claim 1, wherein said indexing and keying structure comprises elongate plate means of limited width mounted rigidly on said shaft perimeter and having said edge with said notches therein, and said disks having clearance recesses therein for receiving said plate means.

3. Apparatus according to claim 2, wherein said inner diameter key means of the disks comprises a recess in each disk inner diameter, and the edges of said inner diameters of the disks having at one side of each recess a shoulder comprising said key means and which shoulder is adapted to be received in a selected one of said notches by aligning said key shoulder with the notch and rotating the disk to lodge the key shoulder in the notch, said locking means comprising a locking bar adapted to be slidably engaged in aligned portions of said clearance recesses along a shoulder edge along the opposite edge of said plate means from said notched edge, and means for releasably securing said bar in place.

4. Apparatus according to claim 3, wherein said clearance recesses of alternate ones of said disks are relatively offset from one another so that teeth on the outer perimeters of said assemblies are alternately offset from one another along the length of the assemblies.

5. Apparatus according to claim 1, wherein said notches have edges extending inwardly from their ends for wedging said key means in the notches.

6. Apparatus according to claim 1, wherein said indexing and keying structure extends above the cylindrical perimeter of the shaft and said inner diameters of the disks having clearance recesses for receiving said keying structure.

7. Apparatus according to claim 6, wherein said locking means comprises a locking bar adapted to be replaceably received between cooperating locking shoulders on said disks and said indexing and keying structure.

8. Apparatus according to claim 1, wherein said indexing and keying structure comprises a longitudinal area of cylindrical circumference of said shaft and wherein said area has a longitudinal channel therein, said notches extending circumferentially in said perimeter from a longitudinally extending circumferentially facing edge defining said channel, said key means on said disks comprising radially inwardly extending inner diameter lugs on said disks, said lugs being lodged in said notches and said locking means comprising a locking bar received in said channel and locking said lugs in said notches.

9. A disk assembly for a disk screen apparatus, comprising:

an elongate shaft having means at opposite ends for rotatably mounting the assembly in the disk screen apparatus;

an elongate indexing and keying structure extending longitudinally along and rigid with the perimeter of said shaft and providing a longitudinally extending and circumferentially facing edge;

said edge having a series of longitudinally spaced circumferentially extending indexing and keying notches therein for determining the positions of the disks relative to one another along the length of the shaft;

annular screen disks mounted on said shaft and having inner diameter key means engageable in said notches;

each of said disks being movable along the length of said shaft by sliding its inner diameter along said perimeter and with said key means freely movable along said edge until aligned with a selected notch, and the key means being then assembled in the aligned notch by relative rotation of the disk and shaft;

and means for locking said disks in their selected positions with said key means in said notches and thereby retaining said disks spaced from one another in accordance with said notches and corotative with said shaft.

10. A disk assembly according to claim 9, wherein said indexing and keying structure comprises elongate plate means of limited width mounted rigidly on said shaft perimeter and having said edge with said notches therein, and said disks having clearance recesses therein for receiving said plate means.

11. A disk assembly according to claim 10, wherein said inner diameter key means of the disks comprises a recess in each disk inner diameter, and the edges of said inner diameters of the disks having at one side of each recess a shoulder comprising said key means and which shoulder is adapted to be received in a selected one of said notches by aligning said key shoulder with the notch and rotating the disk to lodge the key shoulder in the notch, said locking means comprising a locking bar adapted to be slidably engaged in aligned portions of said clearance recesses and which occur along a shoulder edge provided by the opposite edge of said plate means from said notched edge after rotating of the disks as aforesaid, and means for releasably securing said bar in place.

12. A disk assembly according to claim 11, wherein said clearance recesses of alternate ones of said disks are relatively offset from one another, so that teeth on the outer perimeter of said assembly are alternatively offset from one another along the length of the assembly.

13. A disk assembly according to claim 9, wherein said notches have edges extending inwardly from their ends for wedging said key means in the notches.

14. A disk assembly according to claim 9, wherein said indexing and keying structure extends above the cylindrical perimeter of the shaft and said inner diameters of the disks having clearance recesses for receiving said keying structure.

15. A disk assembly according to claim 14, wherein said locking means comprises a locking bar adapted to be replaceably received between cooperating locking shoulders on said disks and said indexing and keying structure.

16. A disk assembly according to claim 9, wherein said indexing and keying structure comprises a longitudinal area of the perimeter of said shaft having a longitudinal channel therein, said notches extending circumferentially in said perimeter from a longitudinally extending circumferentially facing edge defining said channel, and said locking means comprising a locking bar received in said channel.

17. A method of making a disk assembly for a disk screen apparatus, comprising:

providing an elongate shaft having means at opposite ends for rotatably mounting the assembly in disk screen apparatus;

providing on said shaft an elongate indexing and keying structure extending longitudinally and rigid with the shaft and with a longitudinally extending and circumferentially facing edge;

forming in said edge a series of longitudinally spaced circumferentially extending indexing and keying notches;

mounting on said shaft annular screen disks having inner diameter key means;

sliding said disks along said shaft and along said edge and aligning said key means of each disk with a selected notch;

engaging said key means in said notches by relatively rotating said disks and said shaft;

and locking said disks in place with said key means in said notches and thereby retaining said disks spaced from one another in accordance with said notches and corotative with said shaft.

18. A method according to claim 17, which comprises providing said indexing and keying structure raised from the shaft perimeter, forming the inner diameters of said disks with clearance recesses to receive said structure and sliding the disks into position on the shaft and aligning key means shoulders at one side of said recesses with selected notches, turning the disks to lodge said key means shoulders in said selected notches, and locking said key means shoulders in said notches by inserting a locking bar between said structure and locking shoulders at the opposite side of said recesses.

19. A method according to claim 17, which comprises providing said indexing and keying structure by forming a longitudinal channel in the cylindrical circumference of said shaft, forming said indexing and keying notches in one edge defining said channel, providing said key means on said disks in the form of radially inwardly extending key lugs, lodging said key lugs in said notches, and inserting a locking bar in said channel for locking said lugs in said notches.

20. A method according to claim 17, which comprises providing said disks with circumferentially uniformly arranged teeth and intervening clearances, and in the disk assembly mounting said disks in alternate half-tooth circumferentially offset relation so that the teeth of alternate disks are in respective longitudinally extending rows.

* * * * *